United States Patent [19]

Johnston

[11] Patent Number: 5,050,826

[45] Date of Patent: Sep. 24, 1991

[54] BODY SUPPORT APPARATUS

[75] Inventor: Keith M. Johnston, Toledo, Ohio

[73] Assignee: Ability Center of Greater Toledo, Sylvania, Ohio

[21] Appl. No.: 547,676

[22] Filed: Jul. 3, 1990

[51] Int. Cl.[5] ..... B43L 15/00

[52] U.S. Cl. ..... 248/118.3; 400/715

[58] Field of Search ..... 248/118.1, 118.3, 118, 248/118.5; 211/123; 193/35 R, 35 MD, 37; 400/715

[56] References Cited

U.S. PATENT DOCUMENTS 1,628,030 5/1927 Catlett ..... 248/118 X

FOREIGN PATENT DOCUMENTS 1510 3/1900 Austria ..... 248/118.3

*Primary Examiner*—Carl D. Friedman
*Assistant Examiner*—Derek J. Berger
*Attorney, Agent, or Firm*—Marshall & Melhorn

[57] ABSTRACT

An apparatus for supporting the hands, wrists, or arms of a keyboard operator. The apparatus includes horizontally mounted support members disposed adjacent a computer keyboard. The support members are preferably padded and are adapted to rotate about and shift along the axis of the shaft to provide continuous support to the operator during keyboard function.

10 Claims, 2 Drawing Sheets

BODY SUPPORT APPARATUS

BACKGROUND OF THE INVENTION present invention relates generally to a body support apparatus and more particularly to an apparatus for supporting the hands, wrists, or arms of the keyboard operators enabling those with motor control disabilities to use a computer keyboard, typewriter and other similar machines. Persons with certain motor control disabilities have difficulties in effectively using keyboards of such equipment due to an inability to maintain their hands steady and move them in a controlled manner. Known rest supports for keyboard operators do not inherently provide the necessary mobility to enable the operator's hands to move in controlled manner.

For instance U.S. Pat. Nos. 4,482,063 and 4,482,556 disclose a computer terminal support and hand rest to be placed on a desk top and interposed between the computer terminal and a computer operator as well as being interposed between the computer terminal and the desk top. The computer terminal support provides a hand rest for supporting the hands of the operator both during the use of the computer terminal and during the rest intervals.

U.S. Pat. No. 4,545,554 discloses a wrist support for use with an office machine having a keyboard designed to fit against the front of the keyboard and provide a means of support for the operator's arms.

U.S. Pat. No. 4,621,781 discloses a forearm rest for use with keyboards for alleviating tension and stress in the upper arms and shoulders.

U.S Pat. No. 4,688,862 discloses a work station or terminal table which enables an operator to make easily performed adjustments of equipment-supporting surfaces, thereby permitting the operator to orient the equipment resting on those surfaces in order to minimize the physical demands on the operator.

U.S. Pat. No. 4,313,585 discloses a rolling support platform device for writing, drawing and the like.

U.S. Pat. No. 988,893 discloses a hand rest for assisting penmanship having on its undersurface, antifriction balls, capable of universal rotation.

U.S. Pat. No. 520,711 discloses a movable arm-rest for writing purposes using crossbars and side bars to provide support to the arm.

SUMMARY OF THE INVENTION

The apparatus of the present invention relates to a hand, wrist, or arm support used in connection with a keyboard or other input board of an office machine or computer terminal. Although other possible uses may exist, the invention is intended primarily to assist those with a motor control disability to effectively use a keyboard. The apparatus is adapted to be positioned in front of a keyboard and includes a horizontal shaft having rotatable cylindrical support pads which can be shifted sideways along the axis of the mounted shaft. The hands, wrists, or arms of the keyboard operator are placed on the support pads to assist in supporting and steadying the hands of the operator. Since the support members are rotatable, the hands can be effectively moved forwards and backwards in a controlled manner and pads can also be moved sideways along the axis of the shaft.

An object of the present invention is to provide a new and improved support member and, more particularly, to an improved support member for use with a computer terminal or similar keyboard which provides a means to allow those with motor control disabilities to reach any key upon the keyboard in a steady controlled efficient manner.

It is another object of the present invention to provide a support member which is capable of simultaneously supporting the hands, wrists or arms of the keyboard operator and allowing forward, backward, and sideward movement without loss of support.

Still another object of the present invention is to provide an apparatus which increases the comfort, alleviates physical stress, and increases the efficiency of a keyboard operator.

Also, the present invention provides an apparatus which will typically increase the employment opportunities of the disabled by alleviating some of the difficulties which heretofore have presented an obstacle to employment as a keyboard operator.

BRIEF DESCRIPTION OF THE OBJECTS AND DRAWINGS

The above, as well as other advantages of the present invention, will become readily apparent to those skilled in the art from reading the following detailed description of a preferred embodiment when considered in the light of the accompanying drawings, in which.

DESCRIPTION OF THE PREFERRED EMBODIMENT

Figure 1:
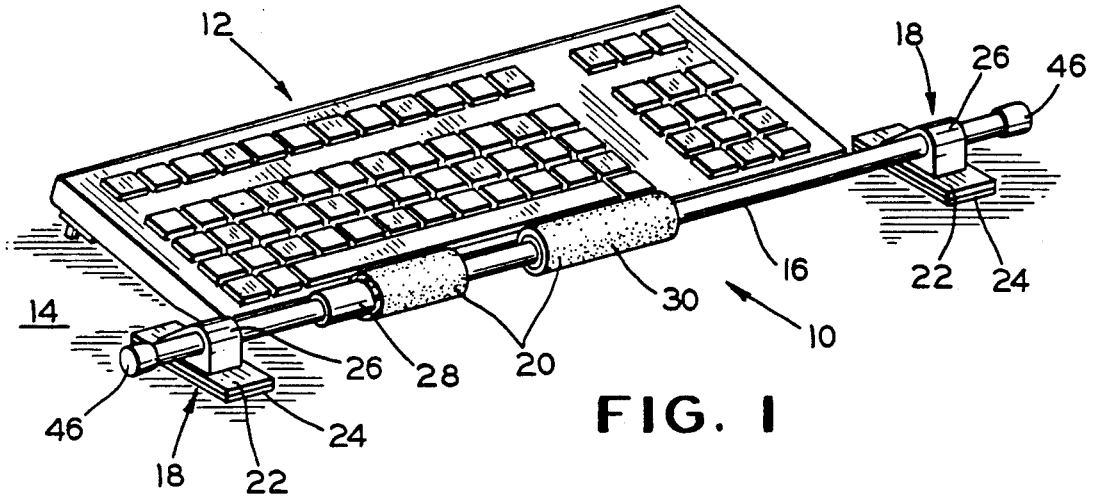
FIG. 1 is a perspective view of a support apparatus embodying the features of the present invention.
Figure 2:
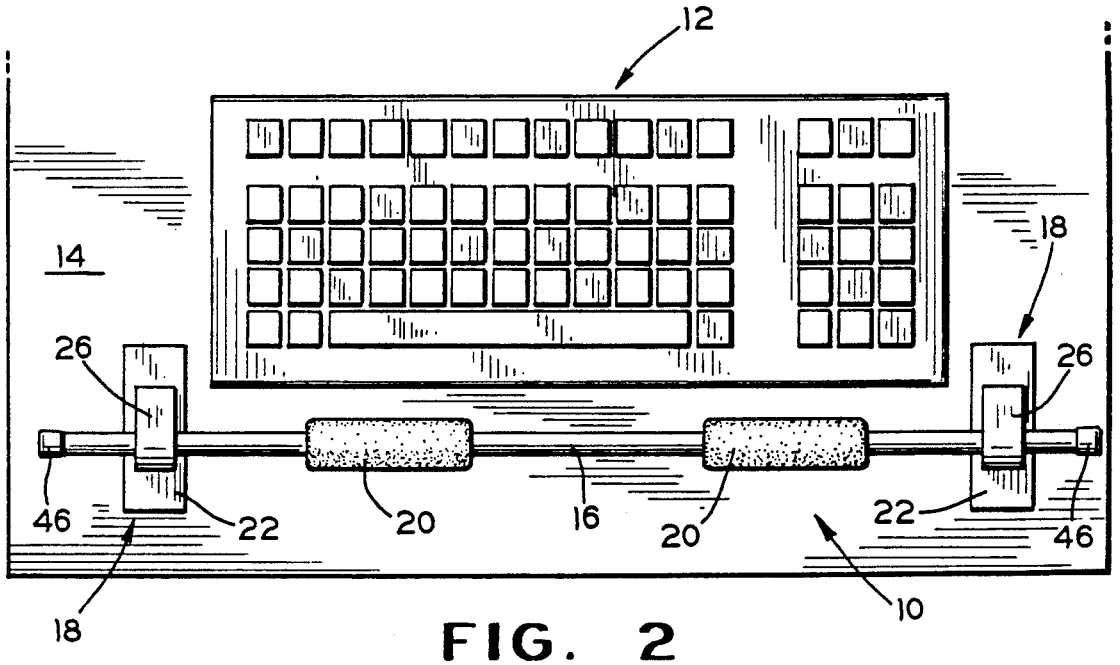
FIG. 2 is top plan view of the apparatus illustrated in FIG. 1.
Figure 3:
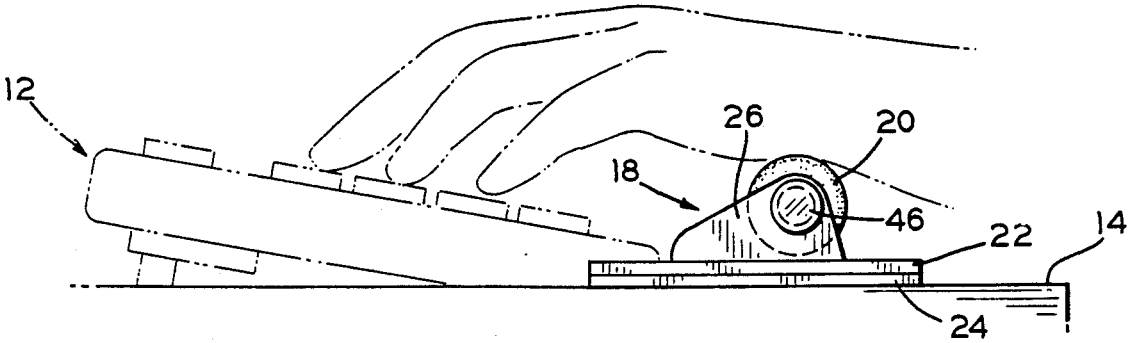
FIG. 3 is a side elevation view of the apparatus shown in FIG. 1.

In FIGS. 1, 2, and 3 there is illustrated a support fixture generally indicated by reference numeral 10 for use by a keyboard operator incorporating the features of the present invention. Although, the support fixture 10 can be used by any keyboard operator, it has been found to be particularly useful for those with motor control disabilities to assist in supporting the individual's hands, wrists, and/or arms. Such persons often encounter great difficulties in finding employment as keyboard operators.

The support fixture 10 is typically placed in front of a keyboard 12. The support fixture 10 and keyboard 12 typically rest on a supporting surface 14 such as a table or desk for example. A horizontally disposed shaft 16 is supported by brackets 18, typically spaced apart a distance greater than the width of the associated keyboard 12. Cylindrical support pad members 20 are rotatably and slidably mounted on the shaft 16 intermediate the brackets 18.

The fixture 10 is adapted to be disposed in front of the keyboard 12 in a manner enabling the operator to easily and comfortably reach the keys of keyboard 12. The hands, wrists or arms of the operator are placed on the support pads 20. The support pads 20 assist in maintaining the hands of the operator steady, enabling the operator to strike the desired key without hitting other unwanted keys on the keyboard. Since the support pads 20 are rotatably mounted, the hands, wrists, and arms of the operator resting on the pads, can effectively move forward (towards the computer) to reach the upper row (numbers row) or effectively move backward to reach the lower row (space bar) of the keyboard 12 by inducing a rotation. Since the support pads 20 are also slidably mounted, the hands, wrists, and arms of the operator are able to reach the first letter of each row and the last letter of each row by moving sideways along the axis of the shaft 16. The above movements can all be accomplished in a controlled manner allowing the disabled operator to type quickly and efficiently.

Each of the brackets 18 consists of a base 22, an elastomeric strip 24, and a shaft retainer 26. The elastomeric strip 24, formed of a rubber compound for example, is adhesively secured to the undersurface of the base 22. The elastomeric strip 24 has a sufficient coefficient of static friction to militate against sideward motion of the base 22 relative to the supporting surface 14. In addition, the elastomeric strip 24 is of sufficient thickness to prevent undue vibration as well as protect the desk or table surface 14 from scratches and abrasions which could be caused by contact with the base 22. The shaft retainer 26, mounted on the upper surface of the base 22, has suitable means for securing the horizontal shaft 16, such as an aperture of slightly greater inside dimension than the outside dimensions of the shaft 16. The means for holding the horizontal shaft 16 enables the shaft to move sideways back and forth through such means. Since sideward movement is allowed, the brackets 18 can be spaced apart at various distances (depending on the width of the keyboard 12) and still retain the shaft 16.

Each support pad 20 consists of a bushing 28 and a cushion 30. The bushing 28 encircles the shaft 16 and can be composed of any suitable material, such as plastic, for example. The cushions 30 encircle the bushings 28 and provide a resting place for the hands, wrists or arms of the operator. The cushions 30 can be comprised of any suitable material, such as foam rubber, for example.

Figure 4:
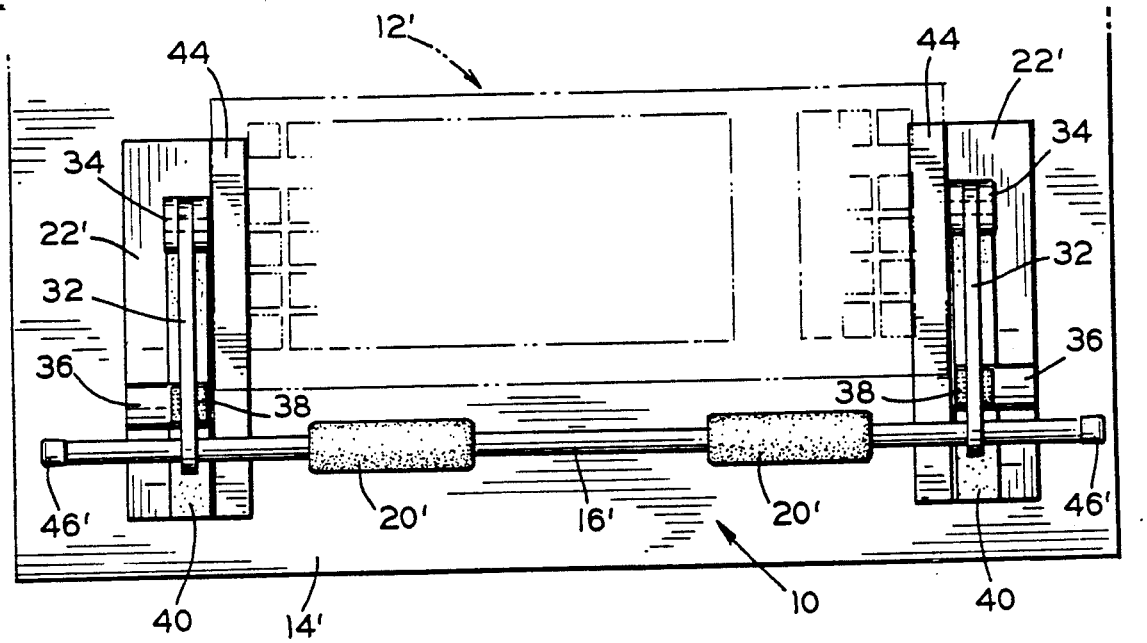
FIG. 4 is top plan view of an alternative embodiment of the present invention.
Figure 5:
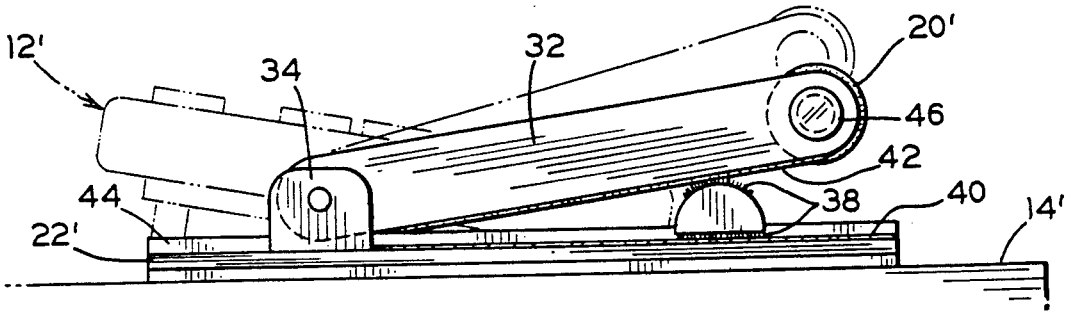
FIG. 5 is a side elevation view of the apparatus illustrated in FIG. 4.
Figure 6:
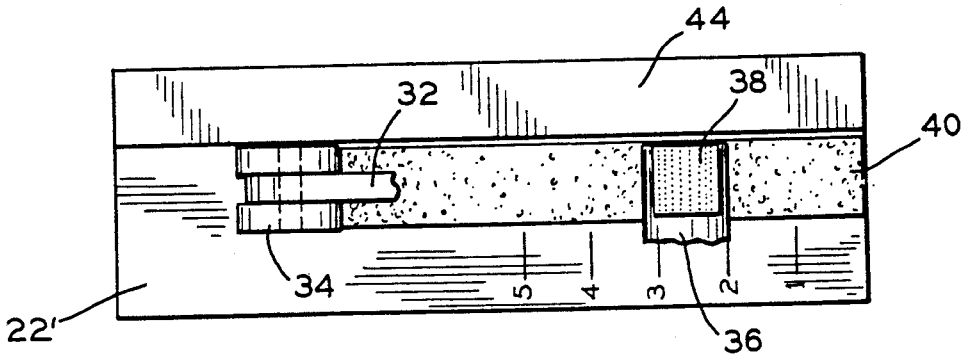
FIG. 6 is a top plan view of the apparatus illustrated in FIGS. 4 and 5 with certain elements cut away to more clearly illustrate the structure.

The support fixture 10 may be provided with an elevating means as illustrated in FIGS. 4, 5, and 6. Such structure provides the user still greater flexibility in obtaining comfort and efficiency. In the illustration of the alternative embodiment, elements similar to those shown in FIGS. 1, 2, and 3 are designated with prime reference numerals. The shaft 16' is securely fastened by retaining means in spaced apart lever arms 32. The lever arms 32 are spaced apart to adequately support a shaft 16'. Suitable means such as the use of apertures in the lever arms 32 having a slightly greater inside dimension than the outside dimensions of the shaft 16', are used to secure the shaft 16'. The lever arms 32 are pivotally connected to respective bases 22' by a suitable means such as a clevis 34. The lever arms 32 are used to raise or lower the shaft 16'. The lever arms 32 are raised by the placement of a spacer element 36 between one or both of the lever arms 32 and on top of a base 22'. The lever arms 32 may be raised as the spacer element 36 is moved closer to the clevis 34. The lever arms 32 and bases 22' can be spaced apart similarly to the brackets in the preferred embodiment.

It has been found that the spacer element 36 may be selectively positioned through the use of an adhesive tape material such as Velcro brand tape, for example. In the illustrated embodiment, one portion of the reusable adhesive material is secured to the upper and lower surface of the spacer element 36 in the form a patch 38. Strips 40 and 42 of cooperating material are secured to the upper surface of the base 22', and the lower or under surface of the lever arms 32, respectively. Typically, Velcro brand tape material is formed of a nylon material made with both a surface of tiny hooks and a complimentary surface of an adhesive pile that can be pressed together or pulled apart for easy fastening and unfastening.

The use of such adhesive means allows the spacer element 36 to be easily retrieved from its position and selectively placed in a new position. As shown in FIG. 6, the base 22' can be provided with spaced apart indicia on the an exposed surface thereof to provide a reference for future use of the particular user's preferred position.

In order to militate against relative movement between the fixture 10 and other objects, for example, the associated keyboard 12' and the supporting surface 14', strips of elastomeric material 44 and 24' may be secured to the respective upper and undersurface of the base 22'. The elastomeric strips 44 and 24' also function to absorb undue vibration as well as protect the respective undersurface of the keyboard 12' and upper surface of the supporting surface 14' from scratches and abrasion which could be caused by contact with the bracket 18'.

Protective caps 46, 46' may be placed on the opposite ends of the shaft 16, 16' to prevent the shaft from sliding out of the aperture of either the respective shaft retainer 26, FIGS. 1, 2, and 3, or lever arms 32, FIGS. 4, 5, and 6.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A body supporting apparatus comprising:

a shaft having a longitudinal axis body support means; and means for mounting said body support means to said shaft for permitting rotation of said body support means to said shaft and about the axis of said shaft and for axial movement relative to said shaft along the axis of said shaft.

2. The apparatus defined in claim 1, including:

means for mounting said shaft in spaced relation above a supporting surface.

3. The apparatus defined in claim 2 wherein said means for mounting said shaft includes:

a base; and shaft retainer means mounted on said base.

4. The apparatus defined in claim 3 including:

means attached to an undersurface of said base adapted to militate against motion of said base relative to the supporting surface.

5. The apparatus according to claim 3 including:

means disposed on said shaft for preventing dislodgement of said shaft from said shaft retainer means.

6. The apparatus defined in claim 2, wherein said means for mounting said shaft includes:

means for adjusting the height of said shaft above the supporting surface.

7. The apparatus defined in claim 1 including:

a base;

at least one lever arm having a first end pivotally connected to said base;

means for mounting said shaft to said lever arm in spaced relation from the first end of said lever arm;

spacer means; and means for separably fastening said spacer means to said base wherein said spacer means effectively supports said lever arm.

8. The apparatus according to claim 7 wherein said lever arm is pivotally attached to said base by a clevis.

9. The apparatus according to claim 8 wherein said body support means includes:

bushing means encircling said shaft; and cushion means mounted on said bushing means.

10. The apparatus according to claim 7 including:

means disposed on said shaft for preventing dislodgment of said shaft from said lever arm.

* * * * *

UNITED STATES PATENT AND TRADEMARK OFFICE

CERTIFICATE OF CORRECTION

PATENT NO. : 5,050,826

DATED : September 24, 1991

INVENTOR(S) : Keith M. Johnston

It is certified that error appears in the above-identified patent and that said Letters Patent is hereby corrected as shown below:

Column 4, line 46, after "means" insert --relative--.

Column 4, line 42, after "axis" insert --;--.

Signed and Sealed this

Third Day of August, 1993

*Attest:*

Michael K. Kirk

MICHAEL K. KIRK

*Attesting Officer*

*Acting Commissioner of Patents and Trademarks*